US012560051B1

(12) United States Patent
Aljohar et al.

(10) Patent No.: US 12,560,051 B1
(45) Date of Patent: Feb. 24, 2026

(54) WELLBORE COMPLETION ASSEMBLY

(71) Applicants: Saudi Arabian Oil Company, Dhahran (SA); Completion Master FZ-LLC, Ras Al Khaimah (AE)

(72) Inventors: Abdulwahab S. Aljohar, Dhahran (SA); Ahmed Mohammed Al Haji, Al Hassa (SA); Anwar Assal, Dubai (AE)

(73) Assignees: Saudi Arabian Oil Company, Dhahran (SA); Completion Master FZ-LLC, Ras Al Khaimah (AE)

( * ) Notice: Subject to any disclaimer, the term of this patent is extended or adjusted under 35 U.S.C. 154(b) by 0 days.

(21) Appl. No.: 18/912,156

(22) Filed: Oct. 10, 2024

(51) Int. Cl.
*E21B 23/00* (2006.01)
*E21B 34/06* (2006.01)
*E21B 34/08* (2006.01)

(52) U.S. Cl.
CPC ..... *E21B 34/08* (2013.01); *E21B 23/004* (2013.01); *E21B 34/063* (2013.01); *E21B 2200/06* (2020.05)

(58) Field of Classification Search
CPC ..... E21B 23/004; E21B 34/063; E21B 34/08; E21B 2200/06
See application file for complete search history.

(56) References Cited

U.S. PATENT DOCUMENTS

| | | | | |
|---|---|---|---|---|
| 4,889,199 | A * | 12/1989 | Lee | E21B 34/142 175/317 |
| 7,337,847 | B2 * | 3/2008 | McGarian | E21B 23/006 166/334.4 |
| 7,357,198 | B2 * | 4/2008 | Mcgarian | E21B 23/006 175/215 |
| 7,416,029 | B2 * | 8/2008 | Telfer | E21B 23/006 166/318 |
| 8,863,853 | B1 | 10/2014 | Harris et al. | |
| 10,597,974 | B2 * | 3/2020 | Atkins | E21B 21/103 |
| 2014/0014360 | A1 * | 1/2014 | Wilson | E21B 23/006 166/321 |
| 2017/0370168 | A1 | 12/2017 | Farrar et al. | |

* cited by examiner

*Primary Examiner* — Matthew R Buck
(74) *Attorney, Agent, or Firm* — Fish & Richardson P.C.

(57) ABSTRACT

A completion assembly includes a completion string and a valve assembly. The completion string is disposed within a wellbore. The valve assembly is coupled to a downhole end of the completion string and includes a housing, a sleeve, a compression spring, and a rotatable indexing assembly. The housing includes a first fluid port and a first shoulder. The housing defines, with a wall of the wellbore, an annulus. The sleeve is disposed within the housing and includes a second fluid port, an indexing slot, and a second shoulder. The valve assembly receives fluid from the completion string to increase a pressure of an inner volume of the valve assembly with respect to the annulus, generating a pressure differential causing the sleeve to axially move, moving the sleeve between an open position with the second fluid port open, and a closed position with the second fluid port closed.

18 Claims, 6 Drawing Sheets

FIG. 3

| Orifice Sizing program | | | |
|---|---|---|---|
| S.G. | Equation | Desired Flow Rate (BPM) | Orifice |
| 1.00 | $y = 0.0946x^{0.5}$ | 4.00 | 0.1892 |
| 1.02 | $y = 0.0951x^{0.5}$ | | 0.1902 |
| 1.04 | $y = 0.0956x^{0.5}$ | | 0.1912 |
| 1.06 | $y = 0.096x^{0.5}$ | | 0.192 |
| 1.08 | $y = 0.0965x^{0.5}$ | | 0.193 |
| 1.10 | $y = 0.0969x^{0.5}$ | | 0.1938 |
| 1.12 | $y = 0.0974x^{0.5}$ | | 0.1948 |
| 1.14 | $y = 0.0978x^{0.5}$ | | 0.1956 |
| Cf - 0.62 | delta P = 1000 | 8 ports | |

WELLBORE COMPLETION ASSEMBLY

TECHNICAL FIELD

This disclosure relates to wellbore completions.

BACKGROUND

Wellbore completions include a completion string and a downhole completion assembly attached to the end of the completion string. The purpose of a wellbore completion is to establish a connection between the surface of the wellbore and an underground reservoir so that fluids can be extracted from or injected into the reservoir. Often, the last stage of constructing a wellbore is to set the completion string in place. Often, the completion process includes pressurizing the completion string multiple times to test the string connections and to activate downhole components such as production packers. Methods and equipment for improving wellbore completions are sought.

SUMMARY

Implementations of the present disclosure include a completion assembly, including a completion string and a valve assembly. The completion string is disposed within a wellbore. The valve assembly is coupled to a downhole end of the completion string and includes a housing, a sleeve, a compression spring, and a rotatable indexing assembly. The housing includes a first fluid port and a first shoulder. The housing defines, with a wall of the wellbore, an annulus. The sleeve is disposed within the housing and includes a second fluid port, an indexing slot, and a second shoulder. The sleeve is axially movable with respect to the housing and includes an outer surface in fluid communication with the annulus through the first fluid port. The compression spring is disposed between the first shoulder and the second shoulder and is arranged to compress or decompress as the sleeve moves axially. The rotatable indexing assembly is disposed between the housing and the sleeve. The rotatable indexing assembly is axially fixed and includes a pin arranged to follow the indexing slot of the sleeve as the sleeve moves axially, thus rotating the rotatable indexing assembly. The valve assembly receives fluid from the completion string to increase a pressure of an inner volume of the valve assembly with respect to the annulus, generating a pressure differential causing the sleeve to axially move, thus compressing the compression spring and rotating the rotatable indexing assembly to move the sleeve between an open position and a closed position. The second fluid port is open to the annulus in the open position, and the second fluid port is blocked from the annulus in the closed position.

In some implementations, the housing further includes a nozzle, the second fluid port aligned with the nozzle in the open position, and the second fluid port misaligned with the nozzle in the closed position.

In some implementations, the nozzle includes a Venturi nozzle including a throat and a diffuser at the annulus. The Venturi nozzle lowers a pressure of the fluid passing through the throat to increase a pressure differential between the annulus and the inner volume, causing the sleeve to move uphole and rotate the rotatable indexing assembly to a subsequent position.

In some implementations, the completion assembly further includes a plurality of seal stacks residing between the housing and the sleeve, the nozzle residing between a first seal stack and a second seal stack of the plurality of seal stacks, and the first fluid port residing between the second seal stack and a third seal stack of the plurality of seal stacks.

In some implementations, the completion assembly further includes a spacer ring disposed between the second seal stack and the third seal stack, the spacer ring arranged to maintain the second seal stack and third seal stack in place.

In some implementations, the completion assembly further includes a Smalley ring disposed between the second seal stack and the third seal stack, the Smalley ring locks the first seal stack in the seal housing.

In some implementations, the housing includes an uphole sub, a downhole sub, and a middle housing assembly threadedly coupled to and residing between the uphole sub and the downhole sub, the middle housing assembly including a spring housing attached to the uphole sub, a seal housing attached to the downhole sub, and an indexing housing disposed between and threadedly attached to the spring housing and the seal housing.

In some implementations, the sleeve includes a spring mandrel, a piston mandrel, and an indexing mandrel threadedly attached to and disposed between the spring mandrel and the piston mandrel.

In some implementations, the first shoulder includes a wall of an annular slot of the housing and the second shoulder includes an outwardly projecting shoulder extending from the outer surface of the sleeve, the compression spring disposed within the annular slot.

In some implementations, the completion assembly further includes a spring bearing assembly coupled to the compression spring, the compression spring bearing assembly disposed between the wall of the annular slot and the compression spring, the compression spring bearing assembly rotates to prevent torsion of the compression spring.

In some implementations, the completion assembly further includes a second compression spring, the housing including a second annular slot and the second compression spring disposed within the second annular slot, the second compression spring residing between the rotatable indexing assembly and a second wall of the second annular slot.

In some implementations, the second fluid port is one of a plurality of fluid ports of the sleeve, the plurality of fluid ports aligned annularly and residing, in the open position, at an elevation of a nozzle of the housing.

In some implementations, the rotatable indexing assembly includes a pair of ball bearings and a ring attached to and disposed between the pair of bearings, the pin fixed to the ring and extending inwardly into the indexing slot.

In some implementations, the outer surface of the sleeve includes an external upset that forms a volume that receives fluid from the annulus to allow the sleeve to experience the pressure differential.

In some implementations, the completion assembly further includes a rupture disk attached to the housing or the wellbore and disposed downhole of the sleeve, the valve assembly directs, with the valve assembly closed, fluid to the rupture disk to break the rupture disk and open a fluid pathway past the rupture disk.

Implementations of the present disclosure include a wellbore tool that includes a housing, a sleeve, a compression spring, and an indexing assembly. The housing is coupled to a downhole end of a wellbore string disposed within a wellbore. The housing includes a first fluid port and a first shoulder. The housing defines, with a wall of the wellbore, an annulus. The sleeve is disposed within the housing and includes a second fluid port, an indexing slot, and a second shoulder. The sleeve is axially movable with respect to the housing and including an outer surface in fluid communication with the annulus through the first fluid port. The compression spring is disposed between the first shoulder and the second shoulder and arranged to compress or decompress as the sleeve moves axially. The indexing assembly is disposed between the housing and the sleeve. The indexing assembly includes a pin axially fixed and arranged to rotate as the pin follow the indexing slot of the sleeve as the sleeve moves axially. The sleeve receives fluid from the wellbore string to increase a pressure of an inner volume of the sleeve with respect to the annulus, generating a pressure differential causing the sleeve to axially move, compressing the spring and rotating the indexing assembly to move the sleeve between an open position and a closed position, the second fluid port open to the annulus in the open position, and the second fluid port blocked from the annulus in the closed position.

In some implementations, the housing further includes a nozzle, the second fluid port aligned with the nozzle in the open position, and the second fluid port misaligned with the nozzle in the closed position.

In some implementations, the nozzle includes a throat and a diffuser at the annulus, the nozzle arranged to lower a pressure of the fluid passing through the throat to increase a pressure differential between the annulus and the inner volume, causing the sleeve to move uphole and rotate the pin of the indexing assembly to a subsequent position of the indexing slot.

Implementations of the present disclosure include a method that includes flowing a fluid into a completion valve. The completion valve is attached to a downhole end of a completion string disposed within a wellbore. The completion valve includes a housing, a spring-loaded sleeve, and a rotatable indexing assembly. The housing includes a first fluid port and defines, with a wall of the wellbore, an annulus. The spring-loaded sleeve is disposed within the housing and includes a second fluid port and an indexing slot. The spring-loaded sleeve is axially movable with respect to the housing and includes an outer surface in fluid communication with the annulus through the first fluid port. The rotatable indexing assembly is disposed between the housing and the spring-loaded sleeve. The rotatable indexing assembly is axially fixed and including a pin arranged to follow the indexing slot of the spring-loaded sleeve as the spring-loaded sleeve moves axially, rotating the rotatable indexing assembly. The method also includes pressurizing, with the fluid, a bore of the completion valve, generating a pressure differential between the annulus and the bore that causes the spring-loaded sleeve to axially move, compressing a spring of the spring-loaded sleeve and rotating the rotatable indexing assembly to move the spring-loaded sleeve between an open position and a closed position. The second fluid port is open to the annulus in the open position, and the second fluid port is blocked from the annulus in the closed position.

In some implementations, the flowing includes flowing at one of 4 barrels per minute, 7 barrels per minute, or 9 barrels per minute.

Particular implementations of the subject matter described in this specification can be implemented so as to realize one or more of the following advantages. For example, the completion assembly of the present disclosure allows the completion assembly to perform multiple pressurization procedures without using ball seat assemblies, test plugs, or wireline equipment, which can save time and resources. Moreover, the completion valve of the present disclosure can be used with traditional completion strings, which can save time and resources.

DETAILED DESCRIPTION OF THE DISCLOSURE

Figure 1:
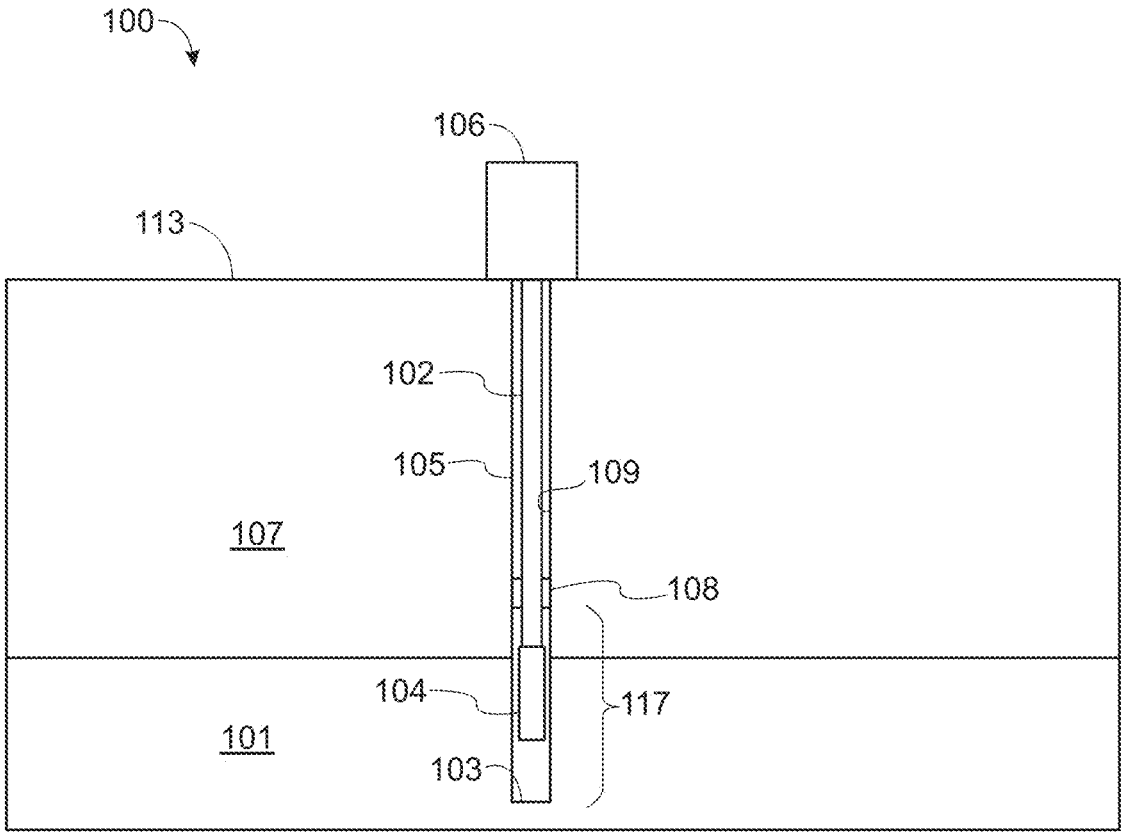
FIG. 1 shows a front schematic view, partially cross-sectional, of an example completion assembly.

FIG. 1 shows a wellbore assembly 100 (e.g., a completion assembly) that includes a completion string 102 and a valve assembly 104 (e.g., a downhole completion assembly, a valve, or a wellbore tool) coupled to a downhole end of the completion string 102.

The wellbore 105 extends through a subterranean zone 107 that includes a geologic formation 101. For example, the wellbore 105 extends down from a surface 113 (e.g., a terranean surface) of the wellbore 105 and is formed in the geologic formation 101. The geologic formation 101 includes a hydrocarbon reservoir from which hydrocarbons can be extracted.

The completion string 102 extends from surface equipment 106 (e.g., a rig, a truck, etc.) to a downhole location of the wellbore 105. The completion string is set in a wall 109 of the wellbore 105 by one or more packers 108. The valve assembly 104 resides downhole of the packers 108. For example, the valve assembly 104 resides in an isolated area 117 defined between the packer 108 and a downhole end 103 (or rupture disk) of the wellbore 105.

Figure 2:
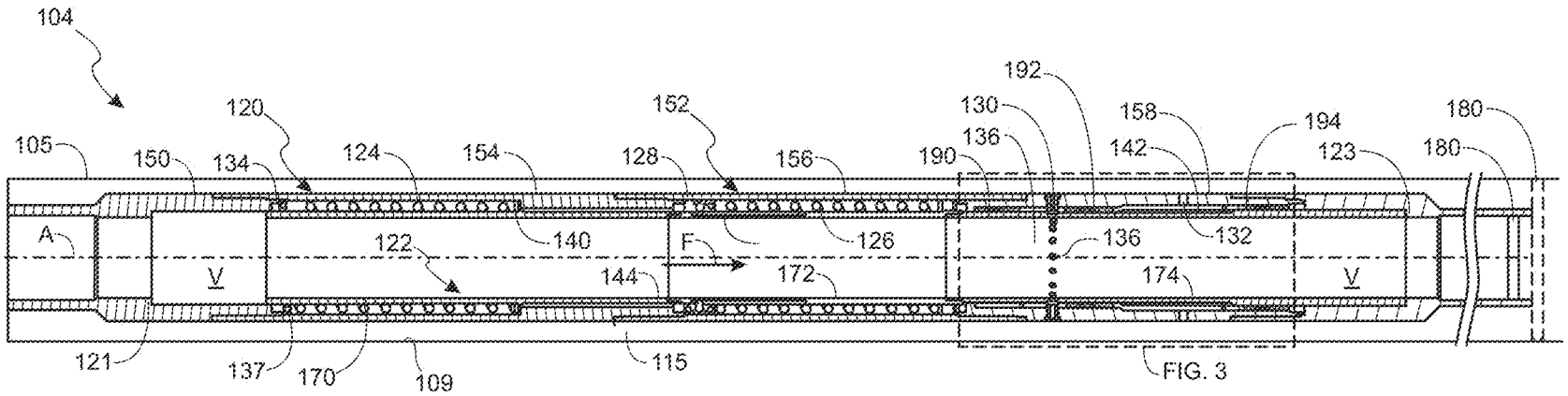
FIG. 2 shows a front view, cross-sectional, of an example valve assembly.

FIG. 2 shows the valve assembly 104 in the wellbore 105. The valve assembly 104 has a housing 120 (e.g., a housing assembly), a sleeve 116 (e.g., a sleeve assembly or mandrel assembly), two compression springs 124, 126, and an indexing assembly 128. The housing 120 has a nozzle 130, a first fluid port 132, and a first shoulder 134. The housing 120 defines, with the wall 109 of the wellbore 105, an annulus 115.

The sleeve 122 is disposed within the housing 120. In some aspects, the sleeve 122 is rotationally fixed with respect to the housing 120, but moves axially (e.g., along central axis "A") inside the housing 120. The sleeve 122 moves between a first stop shoulder 121 of the housing 120 and a second stop shoulder 123 of the housing 120. The housing 120 includes a second fluid port 136, an indexing slot 138, and a second shoulder 140 (e.g., a retaining ring or snap ring). The sleeve 122 is axially movable with respect to the housing 120. The sleeve 122 has an outer surface 142 in fluid communication with the annulus 115 through the first fluid port 132.

The compression spring 126 is disposed between the first shoulder 134 and the second shoulder 140. The compression spring 126 biases the sleeve 122 away from the first shoulder 134, in a downhole direction. As the sleeve 122 moves axially in an uphole direction, the second shoulder 140 moves toward the first shoulder 134, compressing the spring 124.

The indexing assembly 128 is rotatably attached to the housing 120. The indexing assembly 128 resides between the housing 120 and the sleeve 122. In some aspects, the indexing assembly 128 is axially fixed but rotates with respect to both the housing 120 and the sleeve 122. Specifically, the indexing assembly 128 does not move along the central axis "A," but the indexing slot 138 of the sleeve 122 causes the indexing assembly 128 to rotate as the sleeve 122 reciprocates (e.g., moves linearly back and forth). The indexing assembly 128 rotates to follow the indexing slot 138 of the sleeve 122.

The indexing slot 138 is designed to cause the indexing assembly 128 to rotate in one direction. For example, as the sleeve 122 axially moves, under pressure differential forces, in an uphole direction, the indexing slot 138 rotates the indexing assembly in one direction (e.g., clockwise direction) to a subsequent position of the indexing slot 138. Similarly, as the sleeve 122 axially moves, under the force of the spring 124, in a downhole direction, the indexing slot 138 rotates the indexing assembly in the same direction (e.g., clockwise direction) to a subsequent position of the indexing slot 138.

Figure 8:
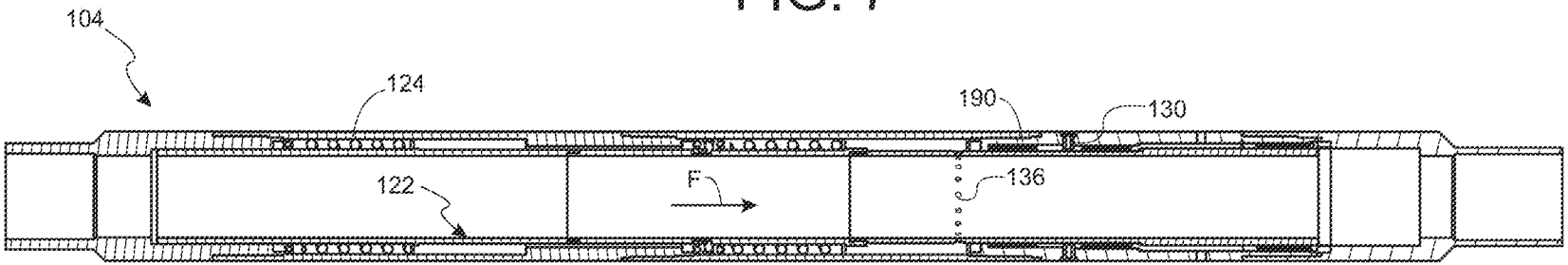
FIG. 8 is a front view, cross-sectional, of the valve assembly in a cycled closed position.
Figure 9:
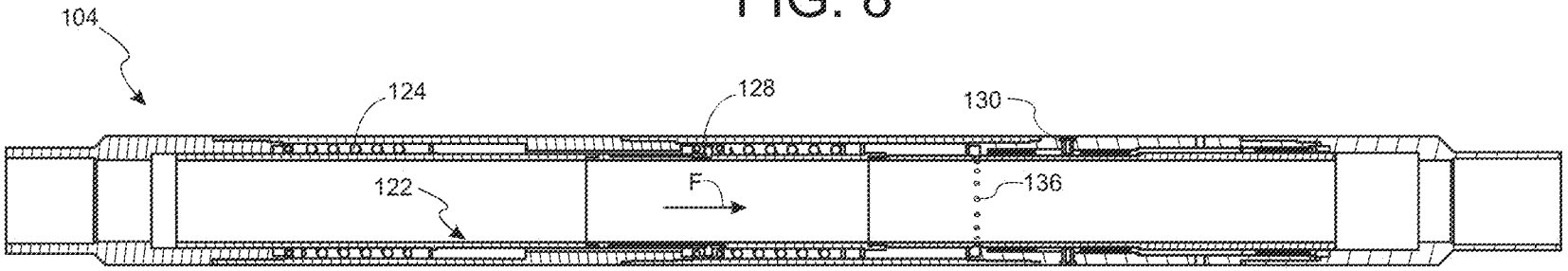
FIG. 9 is a front view, cross-sectional, of the valve assembly in a closed position.

To open or close the valve assembly 104, the valve assembly 104 cycles the sleeve 122 between a closed position and an opened position. For example, the valve assembly 104 receives fluid "F" from the completion string to increase a pressure of an inner volume "V" of the valve assembly 104. The pressure of the inner volume "V" is increased with respect to the pressure of the annulus 115, generating a pressure differential between the bore 144 of the sleeve 122 and the annulus 115. Such pressure differential is felt by the sleeve 122 through the first fluid port 132, causing the sleeve 122 to axially move in an uphole direction, compressing the spring 124. Such movement also rotates the rotatable indexing assembly 128 to lock the sleeve 122 between an open position, in which the second fluid port 136 of the sleeve 122 is open to the annulus 115 (as shown in FIG. 2), and a closed position, in which the second fluid port 136 is blocked from the annulus 115 (as shown in FIGS. 8 and 9).

In some aspects, the housing 120 includes an uphole sub 150, a downhole sub 160, and a middle housing assembly 152 threadedly coupled to and residing between the uphole sub 150 and the downhole sub 160. The middle housing assembly 152 includes a spring housing 154 attached to the uphole sub 150, a seal housing 158 attached to the downhole sub, and an indexing housing 156 disposed between and threadedly attached to the spring housing 154 and the seal housing 158.

In some aspects, the sleeve 122 includes a spring mandrel 170, a piston mandrel 174, and an indexing mandrel 172 threadedly attached to and disposed between the spring mandrel 170 and the piston mandrel 174.

In some aspects, the completion assembly 100 also includes a rupture disk 180 attached to the housing 120 or the wellbore 105. The rupture disk 180 resides downhole of the sleeve 122 to allow the interior volume of the sleeve 122 to be pressurized with fluid flowed from the surface of the wellbore 105. Once the completion operation is completed, the completion string flows fluid, with the valve assembly 104 closed, to the rupture disk 180 to break the rupture disk 180 and open a fluid pathway past the rupture disk 180.

The valve assembly 104 also has multiple fluid seals 190, 192, 194 that allow the valve assembly 104 to be opened and closed. Each fluid seal 190 can be, for example, a seal stack such as a non-elastomeric seal stack provided by Utex Industries, located in Houston, TX, USA, or a seal stack provided by MSC Direct, located in Melville, NY, USA. In some aspects, the fluid seals 190, 192, 194 are made of Teflon-based materials providing low friction and high temperature and high pressure capabilities.

In some aspects, the valve assembly 104 has a second compression spring 126. The two springs 124, 126 are mounted in parallel to provide for a large spring force in a confined area. Each of the springs 124, 126 reside within respective annular slots of the housing 120. For example, the first shoulder 134 is a wall of the first annular slot, and the second spring 126 resides between two walls of the second annular slot. As further described in detail below with respect to FIG. 10, the flow rate of the fluid "F" is calculated as a function of the force of the two compression springs 124, 126 and any friction forces (e.g., friction from the fluid seals) at play to ensure that the pressure differential created is enough to push the sleeve 122 to the next position. In some aspects, the springs and seals are designed such that the sleeve needs to be subject to at least 1000 pounds per square inch (PSI) to move the sleeve 122.

In some aspects, the valve assembly 104 also includes a spring bearing assembly 13 coupled to the first spring 124. The spring bearing assembly 124 resides between the wall 134 of the annular slot and the spring 124. The spring bearing assembly 137 rotates to prevent torsion of the spring 124. In other words, the spring bearings 124 help eliminate torsional loads on the springs during compression and expansion. This allows the sleeve 122 to travel longitudinally through the seal stacks without inducing torsional loads adding to the system's overall frictional loads.

In some aspects, the second fluid port 136 is one of multiple (e.g., 16 holes) fluid ports 136 of the sleeve 122. The multiple fluid ports 136 are aligned annularly and raise, when the valve 104 is in the open position, at the same elevation as the nozzle 130.

Figure 3:
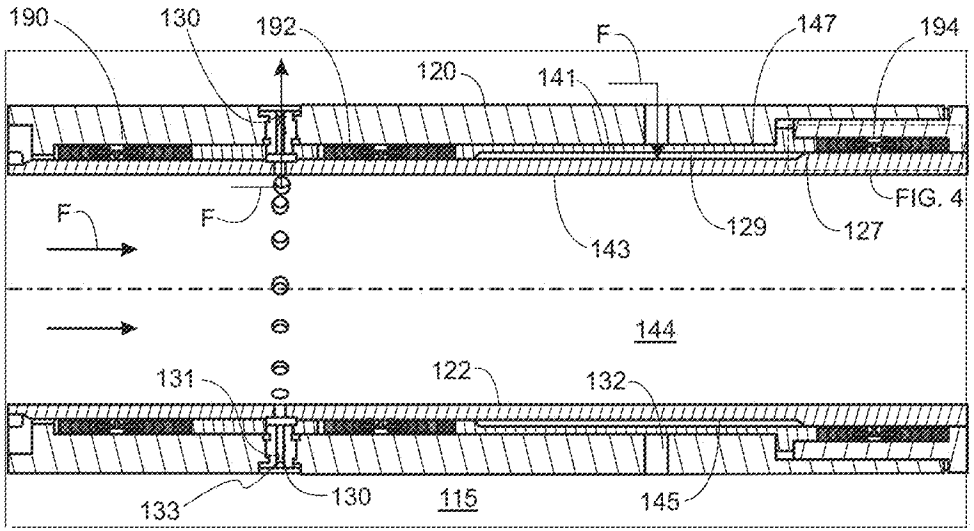
FIG. 3 shows a detail view of a section of the valve assembly, boxed in FIG. 2.

FIG. 3 shows a detailed view of a section of the valve assembly 104. As shown in FIG. 3, the housing 120 has two or more nozzles 130. Each nozzle 130 has a throat 131 and a diffuser 133 at the annulus 115. In some aspects, the nozzle 130 is a Venturi nozzle 130. The Venturi nozzle 130 lowers a pressure of the fluid "F" passing through the throat 131 and into the diffuser 133. The Venturi nozzle 130 thus increases a pressure differential between the annulus 115 and the inner volume of the sleeve 122, in which the pressure in the annulus 115 is significantly lower than the pressure inside the sleeve 122.

The pressure differential between the annulus 115 and the inner volume of the sleeve 122 causes the sleeve 122 to move uphole and rotate the rotatable indexing assembly 128 to a subsequent position. Specifically, the sleeve 122 has an external upset 127 (e.g., a transition between a two portions of different diameters) that creates an annular volume 129 exposed to the fluid "F" at the annulus 115 through the apertures 132. As the fluid "F" exits the nozzle, 130, the pressure of the fluid "F" in the annuls becomes smaller than the pressure in the bore 144 of the sleeve 122. Thus, the sleeve 122 experiences a high pressure at its internal surface 143 and a low pressure at its external surface 145. The low pressure in the volume 129 at the external surface 145 creates a "suction" effect, in which the sleeve 122 is urged uphole by the pressure differential experienced at its internal and external surfaces 145, 143. The larger the piston area or volume 129, the less impact the seal friction and spring force have on the operating controls (the easier it is for the sleeve 122 to move up).

The nozzle 130 resides between a first fluid seal 190 and a second fluid seal 192, and the first fluid port 132 resides between the second fluid seal 192 and a third fluid seal 194. The fluid seals 190, 192, 194 are attached to the housing 120 and reside between the housing 120 and the sleeve 122 to prevent fluid from flowing between the housing 20 and the sleeve 122. The volume 129 outside the sleeve 122 is defined between the second fluid seal 192 and the third fluid seal 194.

The valve assembly 104 also includes a spacer ring 141 disposed between the housing 120 and the sleeve 122, and between the second fluid seal 192 and the third fluid seal 194. The spacer ring 141 helps maintain the second fluid seal 192 and third fluid seal 194 in place. The spacer ring allows fluid communication between the outer surface 145 of the sleeve 122 and the annulus 115.

The valve assembly 104 also includes a retaining ring 147 (e.g., a snap ring 147 or Smalley ring 147). The Smalley ring 147 is also disposed between the housing 120 and the sleeve 122, and between the second fluid seal 192 and the third fluid seal 194. In some aspects, the Smally rings 147 are used to close the gap and lock lock the first fluid seal 190 in the seal housing 158.

Figure 4:
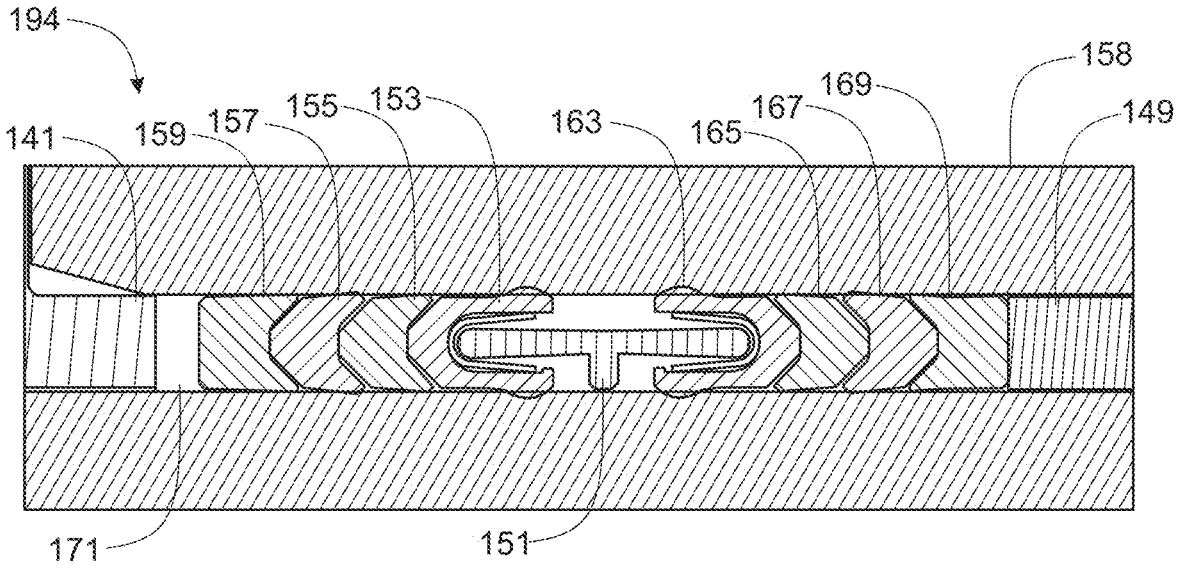
FIG. 4 shows a detail view of a section of the valve assembly, boxed in FIG. 3.

FIG. 4 shows a detail view of the third fluid seal 194 of the valve assembly 104. In some aspects, the other fluid seals 190, 192 are the same as the third fluid seal 192. In some aspects, the third fluid seal 192 is a seal stack 192. The seal stack 192 includes a center ring 151, a pair of radial seals 153, 163, a first pair of v-rings 155, 165, a second pair of v-rings 157, 167, and a pair of backup rings 159, 169. The seal stacks prevent pressurized fluid from flowing, with the valve closed, between the inner volume of the valve and the annulus.

In some aspects, the seal stack 194 resides between two retaining rings 141, 149. The first retaining ring 141 extends from the second seal stack 192 (see FIG. 3) to the third seal stack 194. The second retaining ring 149 is disposed between the third seal stack 194 and a wall (e.g., an inwardly projecting shoulder) of the seal housing 158. The retaining rings 141, 149 retain the seal stacks 192, 194 in place. In some aspects, the retaining rings 141, 149 are spaced from each other a distance to form a gap 171 (e.g., a gland space) that gives the seal stack 194 wiggle room to slightly move with the sleeve or to expand. The segregation of the seal stacks allows the sleeve 122 to always move full stroke to open or close the valve 104.

Figure 5:
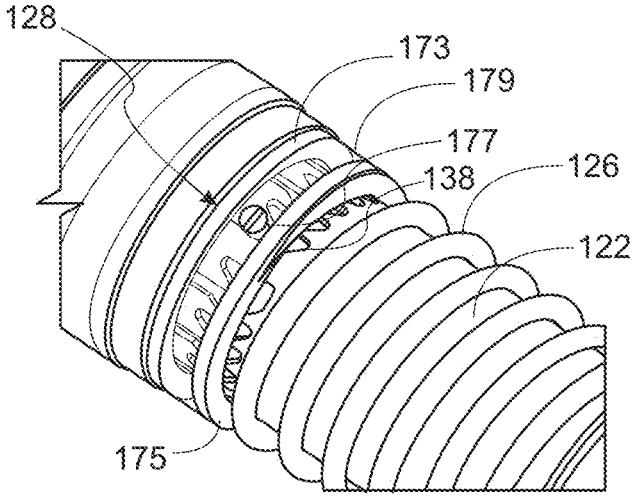
FIG. 5 shows a perspective view of an indexing assembly of the valve assembly shown in FIG. 2.

FIG. 5 shows a perspective view of the rotatable indexing assembly 128. The indexing assembly 128 can be, for example, a thrust bearing 128 that includes a pair of bearing races 173, 175 (e.g., mating bearing races with balls trapped in between) and a ring 179 (e.g., a bearing race) attached to and disposed between the pair of bearings 173, 175. The ring 179 includes an indexing pin 177 fixed to the ring 179 and extending inwardly into the indexing slot 138. In some aspects, the indexing pin 177 is a J-pin threadedly attached to the ring 179. The thrust bearing 128 allows rotation of the ring 179 (and the second spring 126) with respect to the housing 120 and the sleeve 122.

In some aspects, the ring 179 has two pins 177 at opposite ends (e.g., each pin 177 spaced 180 degrees from each other) to increase the strength of the indexer assembly 128. In such case, the slot 138 includes two separate slots of matching shape to allow the sleeve 122 to rotate both pins 177 as the sleeve 122 reciprocates back and forth.

Figure 6:
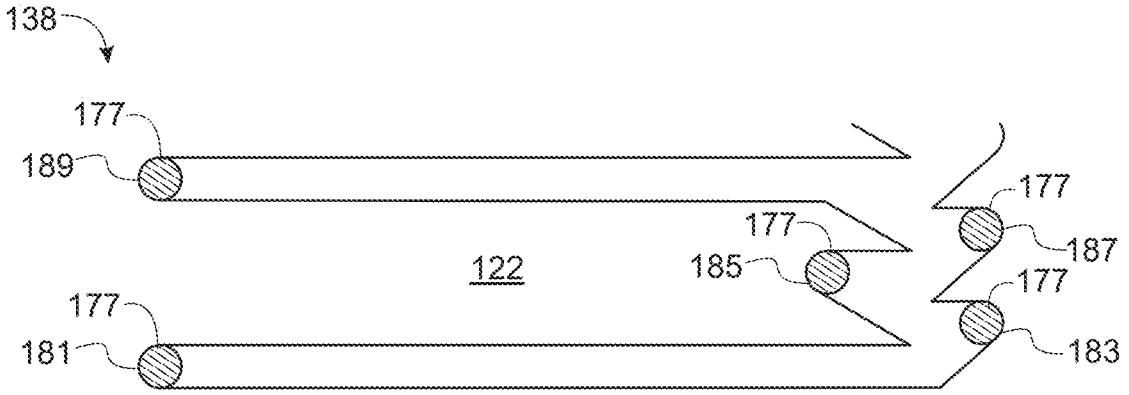
FIG. 6 shows a top schematic view of an indexing slot of the valve assembly shown in FIG. 2.

FIG. 6 is a schematic view of the indexing slot 138 and the path of the indexing pin 177 along one cycle. When the valve assembly 104 is run in hole, the indexing pin 177 is in the first position 181 (e.g., run in open position). In the first position 181, the valve assembly 104 is open. When the sleeve 122 is pushed up the first time by the differential pressure, the sleeve 122 momentarily rotates the pin 177 to the second position 183 (e.g., the first cycled close position), in which the valve assembly is closed. Once the pressure differential decreases (e.g., by stopping the pumping of fluid from the surface), the spring pushes down the sleeve 122 to rotate the pin 177 to the third position 185 (e.g., the closed position). To open the valve assembly 104, the fluid again pressurizes the inner volume of the sleeve 122 (which can take less time because the valve is closed) to again increase the pressure differential between the inner volume and the annulus, causing the sleeve 122 to move up, momentarily rotating the pin 177 to the fourth position 187 (e.g., the second cycled close position). Once the pressure differential decreases (e.g., by stopping the pumping of fluid), the spring pushes down the sleeve 122 to rotate the pin 177 to the fifth position 189 (e.g., the open position). The sleeve 122 can continue to be moved to cycle the valve between open and closed.

In some aspects, the indexing slot 138 extends along the entire circumference of the sleeve 122 so that the indexing pin 177 can be rotated indefinitely. In some aspects, the indexing slot 138 extends along part of the circumference of the sleeve 122 (e.g., has a finite length), so that once the pin 177 reaches the end of the slot 138, the cycles of the valve 104 come to an end.

Figure 7:
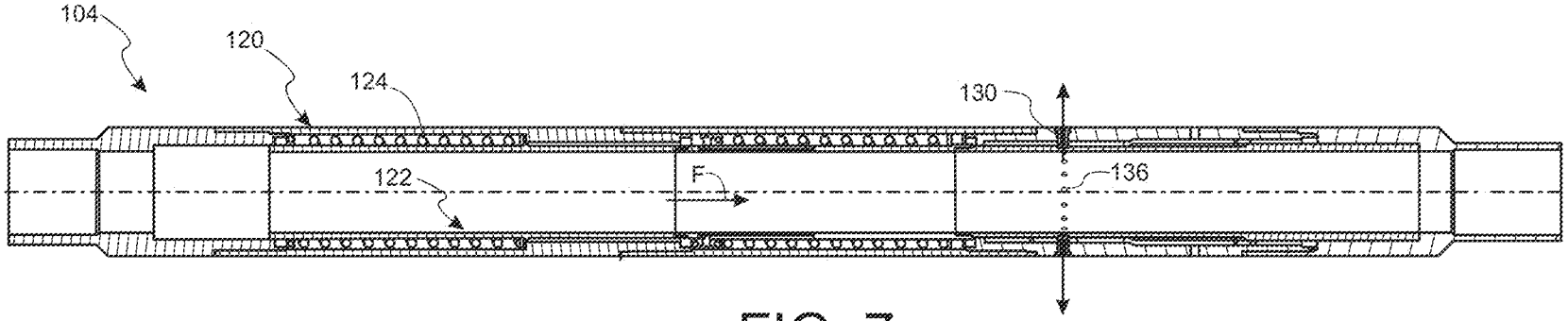
FIG. 7 is a front view, cross-sectional, of the valve assembly in an open position.

FIGS. 7-9 show sequential steps of opening and closing the valve assembly 104. As shown in FIG. 7, the valve assembly 104 is first in an open position. In the open position, the sleeve 122 is at a downhole end of the housing 120, with the fluid ports 136 of the sleeve 122 aligned with the nozzles 130 of the housing 120. With the valve assembly 104 opened, the fluid "F" is flowed out of the valve assembly 104 through the sleeve ports 136 and the nozzles 130. The nozzles 130 lower the pressure of the fluid "F" as the fluid "F" passes through the nozzle 130 into the annulus.

In some aspects, when the valve assembly 104 is opened, the pressure is balanced (e.g., there is no pressure differential between the inside and outside of the valve 104). Thus, the only pressure differential is the one created when the flow rate of the fluid "F" changes, allowing the nozzle 130 to create a pressure differential. When the pressure is lower at the annulus, the sleeve is urged uphole. Conversely, if the pressure in the annulus was greater than the pressure inside the valve, the sleeve would be urged downhole. However, even if the pressure in the annulus goes up, the indexing assembly prevents the sleeve 122 from moving down.

As shown in FIG. 8, as the pressure of the fluid "F" outside the valve assembly 104 decreases, the pressure differential increases, causing the sleeve 122 to move up, compressing the spring 124. When the sleeve 122 is pushed up, the sleeve ports 136 move up past the first fluid seal 190 so that the ports 136 are fluidly isolated from the nozzle 130.

As shown in FIG. 9, once the fluid "F" inside the completion string reaches a certain flow rate or pressure, the pressure or flow rate of the fluid "F" is decreased to allow the spring 124 to push the sleeve 122 down to the next position, e.g., the closed position. In some aspects, the flow rate and pressure of the fluid "F is not decreased, and the sleeve is pushed down just by the pressure in the annulus increasing due to the nozzle 130 being closed. In FIG. 9, the valve assembly 104 is in a closed position, in which the sleeve is locked in place by the indexing assembly 128 until the sleeve 122 is pushed up again to "unlock" the sleeve 122 and allow the spring 124 to push the sleeve 122 back to the open position.

Figures 10, 11:
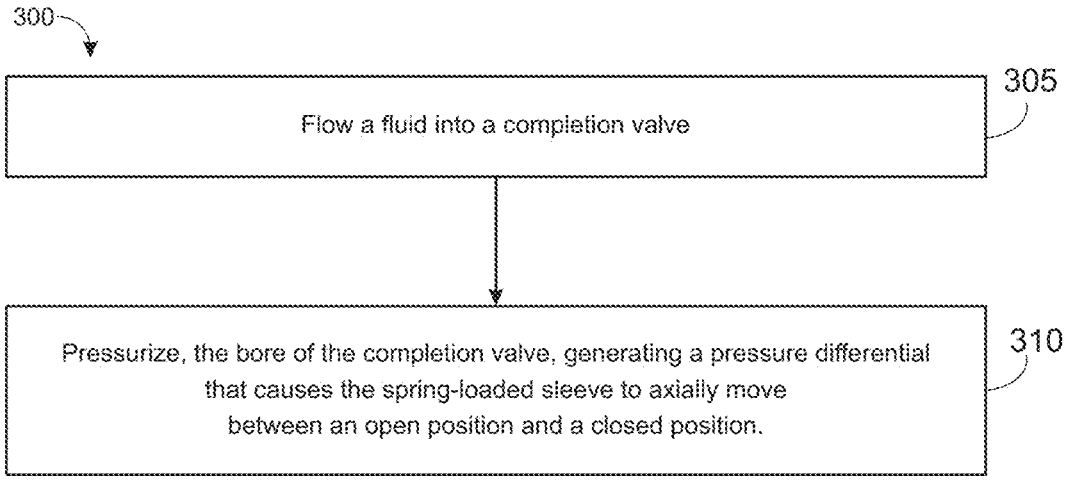
FIG. 10 shows a table of an orifice sizing program for the completion assembly.
FIG. 11 show a flow chart of an example method of setting a completion assembly.

FIG. 10 shows an example table 200 of the orifice sizing program. The first column of the table 200 shows the specific gravity (S.G.) of the completion fluid and the second column shows the equation used for each specific gravity. The third column shows the desired flow rate of the fluid, and the fourth column shows the size of the orifice of the nozzles 130 (see FIG. 2). In some aspects, the desired flow rate is 4 barrels per minute (as shown in FIG. 10), 7 barrels per minute, or 10 barrels per minute. Based on the orifice sizing program, the nozzle orifices are selected before installation. The orifices allow for the desired circulation rates to create the appropriate pressure differential to operate the sleeve and valve. By selecting the desired flow rate, an operator can look up the specific gravity of the completion fluid and work across the chart to select the right size of the orifices to be installed in the completion assembly. The coefficient of friction (Cf) is set to 0.62 but can be adjusted based on tests of the valve assembly.

FIG. 11 shows a flow chart of an example method 300 of installing a completion assembly. The method includes flowing a fluid into a completion valve lowered within a wellbore (305). The completion valve is attached to a downhole end of a completion string disposed within the wellbore. The method also includes pressurizing, with the fluid, the bore of the completion valve to generate a pressure differential between the annulus and the bore that causes the spring-loaded sleeve to axially move to a subsequent position (310). This allows the valve to be cycled between open and closed positions by changing the flow rate of the fluid to test and install the completion system. For example, the completion string can be pressurized when the valve is closed to set the packers of the completion string and to test the completion string.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a completion assembly includes a completion string and a valve assembly. The completion string be disposed within a wellbore. The valve assembly is coupled to a downhole end of the completion string and includes a housing, a sleeve, a compression spring, and a rotatable indexing assembly. The housing includes a first fluid port and a first shoulder. The housing defines, with a wall of the wellbore, an annulus. The sleeve is disposed within the housing and includes a second fluid port, an indexing slot, and a second shoulder. The sleeve is axially movable with respect to the housing and includes an outer surface in fluid communication with the annulus through the first fluid port. The compression spring is disposed between the first shoulder and the second shoulder and is arranged to compress or decompress as the sleeve moves axially. The rotatable indexing assembly is disposed between the housing and the sleeve. The rotatable indexing assembly is axially fixed and includes a pin arranged to follow the indexing slot of the sleeve as the sleeve moves axially, thus rotating the rotatable indexing assembly. The valve assembly receives fluid from the completion string to increase a pressure of an inner volume of the valve assembly with respect to the annulus, generating a pressure differential causing the sleeve to axially move, thus compressing the compression spring and rotating the rotatable indexing assembly to move the sleeve between an open position and a closed position. The second fluid port is open to the annulus in the open position, and the second fluid port is blocked from the annulus in the closed position.

In an example implementation combinable with any other example implementation, the housing further includes a nozzle, the second fluid port aligned with the nozzle in the open position, and the second fluid port misaligned with the nozzle in the closed position.

In an example implementation combinable with any other example implementation, the nozzle includes a Venturi nozzle including a throat and a diffuser at the annulus, the Venturi nozzle configured to lower a pressure of the fluid passing through the throat to increase a pressure differential between the annulus and the inner volume, causing the sleeve to move uphole and rotate the rotatable indexing assembly to a subsequent position.

In an example implementation combinable with any other example implementation, the completion assembly further includes a plurality of seal stacks residing between the housing and the sleeve, the nozzle residing between a first seal stack and a second seal stack of the plurality of seal stacks, and the first fluid port residing between the second seal stack and a third seal stack of the plurality of seal stacks.

In an example implementation combinable with any other example implementation, the completion assembly further includes a spacer ring disposed between the second seal stack and the third seal stack, the spacer ring arranged to maintain the second seal stack and third seal stack in place.

In an example implementation combinable with any other example implementation, the completion assembly further includes a Smalley ring disposed between the second seal stack and the third seal stack, the Smalley ring configured to lock the first seal stack in the seal housing.

In an example implementation combinable with any other example implementation, the housing includes an uphole sub, a downhole sub, and a middle housing assembly threadedly coupled to and residing between the uphole sub and the downhole sub, the middle housing assembly including a spring housing attached to the uphole sub, a seal housing attached to the downhole sub, and an indexing housing disposed between and threadedly attached to the spring housing and the seal housing.

In an example implementation combinable with any other example implementation, the sleeve includes a spring mandrel, a piston mandrel, and an indexing mandrel threadedly attached to and disposed between the spring mandrel and the piston mandrel.

In an example implementation combinable with any other example implementation, the first shoulder includes a wall of an annular slot of the housing and the second shoulder includes an outwardly projecting shoulder extending from the outer surface of the sleeve, the compression spring disposed within the annular slot.

In an example implementation combinable with any other example implementation, the completion assembly further includes a spring bearing assembly coupled to the compression spring, the compression spring bearing assembly disposed between the wall of the annular slot and the compression spring, the compression spring bearing assembly configured to rotate to prevent torsion of the compression spring.

In an example implementation combinable with any other example implementation, the completion assembly further includes a second compression spring, the housing including a second annular slot and the second compression spring disposed within the second annular slot, the second compression spring residing between the rotatable indexing assembly and a second wall of the second annular slot.

In an example implementation combinable with any other example implementation, the second fluid port is one of a plurality of fluid ports of the sleeve, the plurality of fluid ports aligned annularly and residing, in the open position, at an elevation of a nozzle of the housing.

In an example implementation combinable with any other example implementation, the rotatable indexing assembly includes a pair of ball bearings and a ring attached to and disposed between the pair of bearings, the pin fixed to the ring and extending inwardly into the indexing slot.

In an example implementation combinable with any other example implementation, the outer surface of the sleeve includes an external upset that forms a volume that receives fluid from the annulus to allow the sleeve to experience the pressure differential.

In an example implementation combinable with any other example implementation, the completion assembly further includes a rupture disk attached to the housing or the wellbore and disposed downhole of the sleeve, the valve assembly configured to direct, with the valve assembly closed, fluid to the rupture disk to break the rupture disk and open a fluid pathway past the rupture disk.

In an example implementation, a wellbore tool includes a housing, a sleeve, a compression spring, and an indexing assembly. The housing is coupled to a downhole end of a wellbore string disposed within a wellbore. The housing includes a first fluid port and a first shoulder. The housing defines, with a wall of the wellbore, an annulus. The sleeve is disposed within the housing and includes a second fluid port, an indexing slot, and a second shoulder. The sleeve is axially movable with respect to the housing and including an outer surface in fluid communication with the annulus through the first fluid port. The compression spring is disposed between the first shoulder and the second shoulder and arranged to compress or decompress as the sleeve moves axially. The indexing assembly is disposed between the housing and the sleeve. The indexing assembly includes a pin axially fixed and arranged to rotate as the pin follow the indexing slot of the sleeve as the sleeve moves axially. The sleeve receives fluid from the wellbore string to increase a pressure of an inner volume of the sleeve with respect to the annulus, generating a pressure differential causing the sleeve to axially move, compressing the spring and rotating the indexing assembly to move the sleeve between an open position and a closed position, the second fluid port open to the annulus in the open position, and the second fluid port blocked from the annulus in the closed position.

In an example implementation combinable with any other example implementation, the housing further includes a nozzle, the second fluid port aligned with the nozzle in the open position, and the second fluid port misaligned with the nozzle in the closed position.

In an example implementation combinable with any other example implementation, the nozzle includes a throat and a diffuser at the annulus, the nozzle arranged to lower a pressure of the fluid passing through the throat to increase a pressure differential between the annulus and the inner volume, causing the sleeve to move uphole and rotate the pin of the indexing assembly to a subsequent position of the indexing slot.

In an example implementation, a method includes flowing a fluid into a completion valve. The completion valve is attached to a downhole end of a completion string disposed within a wellbore. The completion valve includes a housing, a spring-loaded sleeve, and a rotatable indexing assembly. The housing includes a first fluid port and defines, with a wall of the wellbore, an annulus. The spring-loaded sleeve is disposed within the housing and includes a second fluid port and an indexing slot. The spring-loaded sleeve is axially movable with respect to the housing and includes an outer surface in fluid communication with the annulus through the first fluid port. The rotatable indexing assembly is disposed between the housing and the spring-loaded sleeve. The rotatable indexing assembly is axially fixed and including a pin arranged to follow the indexing slot of the spring-loaded sleeve as the spring-loaded sleeve moves axially, rotating the rotatable indexing assembly. The method also includes pressurizing, with the fluid, a bore of the completion valve, generating a pressure differential between the annulus and the bore that causes the spring-loaded sleeve to axially move, compressing a spring of the spring-loaded sleeve and rotating the rotatable indexing assembly to move the spring-loaded sleeve between an open position and a closed position. The second fluid port is open to the annulus in the open position, and the second fluid port is blocked from the annulus in the closed position.

In an example implementation combinable with any other example implementation, the flowing includes flowing at one of 4 barrels per minute, 7 barrels per minute, or 9 barrels per minute.

What is claimed is:

1. A completion assembly, comprising:

a completion string configured to be disposed within a wellbore; and a valve assembly coupled to a downhole end of the completion string and comprising:

a housing comprising a first fluid port and a first shoulder, the housing defining, with a wall of the wellbore, an annulus;

a sleeve disposed within the housing and comprising a second fluid port, an indexing slot, and a second shoulder, the sleeve axially movable with respect to the housing and comprising an outer surface in fluid communication with the annulus through the first fluid port;

a compression spring disposed between the first shoulder and the second shoulder and arranged to compress or decompress as the sleeve moves axially; and a rotatable indexing assembly disposed between the housing and the sleeve, the rotatable indexing assembly axially fixed and comprising a pin arranged to follow the indexing slot of the sleeve as the sleeve moves axially, rotating the rotatable indexing assembly;

wherein the valve assembly is configured to receive fluid from the completion string to increase a pressure of an inner volume of the valve assembly with respect to the annulus, generating a pressure differential causing the sleeve to axially move, compressing the compression spring and rotating the rotatable indexing assembly to move the sleeve between an open position and a closed position, the second fluid port open to the annulus in the open position, and the second fluid port blocked from the annulus in the closed position; and wherein the housing further comprises a nozzle, the second fluid port aligned with the nozzle in the open position, and the second fluid port misaligned with the nozzle in the closed position, the valve assembly comprising a plurality of seals, the nozzle residing between a first seal and a second seal of the plurality of seals, and the first fluid port residing between the second seal and a third seal of the plurality of seals.

2. The completion assembly of claim 1, wherein the nozzle comprises a Venturi nozzle comprising a throat and a diffuser at the annulus, the Venturi nozzle configured to lower a pressure of the fluid passing through the throat to increase a pressure differential between the annulus and the inner volume, causing the sleeve to move uphole and rotate the rotatable indexing assembly to a subsequent position.

3. The completion assembly of claim 1, wherein the plurality of seals are a plurality of seal stacks residing between the housing and the sleeve, the nozzle residing between a first seal stack and a second seal stack of the plurality of seal stacks, and the first fluid port residing between the second seal stack and a third seal stack of the plurality of seal stacks.

4. The completion assembly of claim 3, further comprising a spacer ring disposed between the second seal stack and the third seal stack, the spacer ring arranged to maintain the second seal stack and third seal stack in place.

5. The completion assembly of claim 4, further comprising a retaining ring disposed between the second seal stack and the third seal stack, the retaining ring configured to lock the first seal stack in the seal housing.

6. The completion assembly of claim 1, wherein the housing comprises an uphole sub, a downhole sub, and a middle housing assembly threadedly coupled to and residing between the uphole sub and the downhole sub, the middle housing assembly comprising a spring housing attached to the uphole sub, a seal housing attached to the downhole sub, and an indexing housing disposed between and threadedly attached to the spring housing and the seal housing.

7. The completion assembly of claim 1, wherein the sleeve comprises a spring mandrel, a piston mandrel, and an indexing mandrel threadedly attached to and disposed between the spring mandrel and the piston mandrel.

8. The completion assembly of claim 1, wherein the first shoulder comprises a wall of an annular slot of the housing and the second shoulder comprises an outwardly projecting shoulder extending from the outer surface of the sleeve, the compression spring disposed within the annular slot.

9. The completion assembly of claim 8, further comprising a spring bearing assembly coupled to the compression spring, the compression spring bearing assembly disposed between the wall of the annular slot and the compression spring, the compression spring bearing assembly configured to rotate to prevent torsion of the compression spring.

10. The completion assembly of claim 1, wherein the second fluid port is one of a plurality of fluid ports of the sleeve, the plurality of fluid ports aligned annularly and residing, in the open position, at an elevation of a nozzle of the housing.

11. The completion assembly of claim 1, wherein the rotatable indexing assembly comprises a pair of ball bearings and a ring attached to and disposed between the pair of bearings, the pin fixed to the ring and extending inwardly into the indexing slot.

12. The completion assembly of claim 1, wherein the outer surface of the sleeve comprises an external upset that forms a volume that receives fluid from the annulus to allow the sleeve to experience the pressure differential.

13. A wellbore tool, comprising:

a housing configured to be coupled to a downhole end of a wellbore string configured to be disposed within a wellbore, the housing comprising a first fluid port and a first shoulder, the housing defining, with a wall of the wellbore, an annulus;

a sleeve disposed within the housing and comprising a second fluid port, an indexing slot, and a second shoulder, the sleeve axially movable with respect to the housing and comprising an outer surface in fluid communication with the annulus through the first fluid port;

a compression spring disposed between the first shoulder and the second shoulder and arranged to compress or decompress as the sleeve moves axially; and an indexing assembly disposed between the housing and the sleeve, the indexing assembly comprising a pin axially fixed and arranged to rotate as the pin follows the indexing slot of the sleeve as the sleeve moves axially;

wherein the sleeve receives fluid from the wellbore string to increase a pressure of an inner volume of the sleeve with respect to the annulus, generating a pressure differential causing the sleeve to axially move, compressing the spring and rotating the indexing assembly to move the sleeve between an open position and a closed position, the second fluid port open to the annulus in the open position, and the second fluid port blocked from the annulus in the closed position, and wherein the housing further comprises a nozzle, the second fluid port aligned with the nozzle in the open position, and the second fluid port misaligned with the nozzle in the closed position, the valve assembly comprising a plurality of seals, the nozzle residing between a first seal and a second seal of the plurality of seals, and the first fluid port residing between the second seal and a third seal of the plurality of seals.

14. A method, comprising:

flowing a fluid into a completion valve, the completion valve attached to a downhole end of a completion string disposed within a wellbore, the completion valve comprising:

a housing comprising a first fluid port and defining, with a wall of the wellbore, an annulus, a spring-loaded sleeve disposed within the housing and comprising a second fluid port and an indexing slot, the spring-loaded sleeve axially movable with respect to the housing and comprising an outer surface in fluid communication with the annulus through the first fluid port, and a rotatable indexing assembly disposed between the housing and the spring-loaded sleeve, the rotatable indexing assembly axially fixed and comprising a pin arranged to follow the indexing slot of the spring-loaded sleeve as the spring-loaded sleeve moves axially, rotating the rotatable indexing assembly, pressurizing, with the fluid, a bore of the completion valve, generating a pressure differential between the annulus and the bore that causes the spring-loaded sleeve to axially move, compressing a spring of the spring-loaded sleeve and rotating the rotatable indexing assembly to move the spring-loaded sleeve between an open position and a closed position, the second fluid port open to the annulus in the open position, and the second fluid port blocked from the annulus in the closed position; and wherein the housing further comprises a nozzle, the second fluid port aligned with the nozzle in the open position, and the second fluid port misaligned with the nozzle in the closed position, the valve assembly comprising a plurality of seals, the nozzle residing between a first seal and a second seal of the plurality of seals, and the first fluid port residing between the second seal and a third seal of the plurality of seals.

15. The method of claim 14, wherein the flowing comprises flowing at one of 4 barrels per minute, 7 barrels per minute, or 9 barrels per minute.

16. A completion assembly, comprising:

a completion string configured to be disposed within a wellbore; and a valve assembly coupled to a downhole end of the completion string and comprising:

a housing comprising a first fluid port and a first shoulder, the housing defining, with a wall of the wellbore, an annulus;

a sleeve disposed within the housing and comprising a second fluid port, an indexing slot, and a second shoulder, the sleeve axially movable with respect to the housing and comprising an outer surface in fluid communication with the annulus through the first fluid port;

a compression spring disposed between the first shoulder and the second shoulder and arranged to compress or decompress as the sleeve moves axially; and a rotatable indexing assembly disposed between the housing and the sleeve, the rotatable indexing assembly axially fixed and comprising a pin arranged to follow the indexing slot of the sleeve as the sleeve moves axially, rotating the rotatable indexing assembly;

wherein the valve assembly is configured to receive fluid from the completion string to increase a pressure of an inner volume of the valve assembly with respect to the annulus, generating a pressure differential causing the sleeve to axially move, compressing the compression spring and rotating the rotatable indexing assembly to move the sleeve between an open position and a closed position, the second fluid port open to the annulus in the open position, and the second fluid port blocked from the annulus in the closed position, wherein the first shoulder comprises a wall of an annular slot of the housing and the second shoulder comprises an outwardly projecting shoulder extending from the outer surface of the sleeve, the compression spring disposed within the annular slot, and wherein the completion assembly further comprises a second compression spring, the housing comprising a second annular slot and the second compression spring disposed within the second annular slot, the second compression spring residing between the rotatable indexing assembly and a second wall of the second annular slot.

17. A completion assembly, comprising:

a completion string configured to be disposed within a wellbore; and a valve assembly coupled to a downhole end of the completion string and comprising:

a housing comprising a first fluid port and a first shoulder, the housing defining, with a wall of the wellbore, an annulus;

a sleeve disposed within the housing and comprising a second fluid port, an indexing slot, and a second shoulder, the sleeve axially movable with respect to the housing and comprising an outer surface in fluid communication with the annulus through the first fluid port;

a compression spring disposed between the first shoulder and the second shoulder and arranged to compress or decompress as the sleeve moves axially; and a rotatable indexing assembly disposed between the housing and the sleeve, the rotatable indexing assembly axially fixed and comprising a pin arranged to follow the indexing slot of the sleeve as the sleeve moves axially, rotating the rotatable indexing assembly;

wherein the valve assembly is configured to receive fluid from the completion string to increase a pressure of an inner volume of the valve assembly with respect to the annulus, generating a pressure differential causing the sleeve to axially move, compressing the compression spring and rotating the rotatable indexing assembly to move the sleeve between an open position and a closed position, the second fluid port open to the annulus in the open position, and the second fluid port blocked from the annulus in the closed position, and wherein the completion assembly further comprises a rupture disk attached to the housing or the wellbore and disposed downhole of the sleeve, the valve assembly configured to direct, with the valve assembly closed, fluid to the rupture disk to break the rupture disk and open a fluid pathway past the rupture disk.

18. A wellbore tool, comprising:

a housing configured to be coupled to a downhole end of a wellbore string configured to be disposed within a wellbore, the housing comprising a first fluid port and a first shoulder, the housing defining, with a wall of the wellbore, an annulus;

a sleeve disposed within the housing and comprising a second fluid port, an indexing slot, and a second shoulder, the sleeve axially movable with respect to the housing and comprising an outer surface in fluid communication with the annulus through the first fluid port;

a compression spring disposed between the first shoulder and the second shoulder and arranged to compress or decompress as the sleeve moves axially; and an indexing assembly disposed between the housing and the sleeve, the indexing assembly comprising a pin axially fixed and arranged to rotate as the pin follows the indexing slot of the sleeve as the sleeve moves axially;

wherein the sleeve receives fluid from the wellbore string to increase a pressure of an inner volume of the sleeve with respect to the annulus, generating a pressure differential causing the sleeve to axially move, compressing the spring and rotating the indexing assembly to move the sleeve between an open position and a closed position, the second fluid port open to the annulus in the open position, and the second fluid port blocked from the annulus in the closed position;

wherein the housing further comprises a nozzle, the second fluid port aligned with the nozzle in the open position, and the second fluid port misaligned with the nozzle in the closed position, and the nozzle comprises a throat and a diffuser at the annulus, the nozzle arranged to lower a pressure of the fluid passing through the throat to increase a pressure differential between the annulus and the inner volume, causing the sleeve to move uphole and rotate the pin of the indexing assembly to a subsequent position of the indexing slot.

* * * * *